US009049904B2

(12) United States Patent
Kamiya et al.

(10) Patent No.: US 9,049,904 B2
(45) Date of Patent: Jun. 9, 2015

(54) BUTTON FASTENER, METHOD FOR FORMING BUTTON FASTENER, EYELET, AND METHOD FOR FORMING EYELET

(75) Inventors: Yoshitaka Kamiya, Tokyo (JP); Kenji Hasegawa, Tokyo (JP)

(73) Assignee: YKK Corporation (JP)

( * ) Notice: Subject to any disclaimer, the term of this patent is extended or adjusted under 35 U.S.C. 154(b) by 313 days.

(21) Appl. No.: 13/581,359

(22) PCT Filed: Feb. 26, 2010

(86) PCT No.: PCT/JP2010/053100

§ 371 (c)(1),
(2), (4) Date: Aug. 27, 2012

(87) PCT Pub. No.: WO2011/104867

PCT Pub. Date: Sep. 1, 2011

(65) Prior Publication Data

US 2012/0317760 A1 Dec. 20, 2012

(51) Int. Cl.

| | |
|---|---|
| ***A43B 5/00*** | (2006.01) |
| ***A41F 1/00*** | (2006.01) |
| ***B21D 53/48*** | (2006.01) |

(Continued)

(52) U.S. Cl.

CPC .. *A44B 1/44* (2013.01); *Y10T 29/13* (2015.01); *Y10T 24/3747* (2015.01); *Y10T 24/45225* (2015.01); *A44B 13/0076* (2013.01); *A44B 17/0005* (2013.01)

(58) Field of Classification Search

CPC ..... A44B 1/44; A44B 17/00; A44B 17/0017; A41H 37/001; A41H 37/005; A43D 100/02; Y10T 24/45225; Y10T 24/3447; Y10T 29/13

USPC ..... 24/691, 94, 96, 713.8; 72/324; 29/4

See application file for complete search history.

(56) References Cited

U.S. PATENT DOCUMENTS

| | | | | |
|---|---|---|---|---|
| 660,558 | A * | 10/1900 | Carpenter | 24/95 |
| 1,841,578 | A * | 1/1932 | Fenton et al. | 24/95 |

(Continued)

FOREIGN PATENT DOCUMENTS

| | | |
|---|---|---|
| JP | S40-412 | 1/1965 |
| JP | S55-145911 | 10/1980 |

(Continued)

OTHER PUBLICATIONS

Office Action, Japanese Patent Application No. 2012-501595, mailed Jan. 14, 2014.

(Continued)

*Primary Examiner* — Robert J Sandy

(74) *Attorney, Agent, or Firm* — Kilpatrick Townsend & Stockton LLP

(57) ABSTRACT

A button fastener made of metal for fastening a button such as a male snap button or a decorative button to a cloth, includes a plate-like base and a cylindrical post projecting from a center area of the base. The upper end face of the post is open as a top opening, and the lower end face of the post is open in the center area of the base as a bottom opening. To the button fastener, a closing member which closes the inside of the post at a proximal side thereof is provided. The closing member is a closing part which has been cut out, by a punch, of an unfinished post of a semifinished product which is fabricated to the button fastener and then displaced by the punch through the inside of the unfinished post toward the lower end.

12 Claims, 7 Drawing Sheets

(51) Int. Cl.

| | |
|---|---|
| ***A44B 1/44*** | (2006.01) |
| ***A44B 13/00*** | (2006.01) |
| ***A44B 17/00*** | (2006.01) |

(56) References Cited

U.S. PATENT DOCUMENTS

| | | | | |
|---|---|---|---|---|
| 1,862,076 | A * | 6/1932 | Carley et al. | 24/95 |
| 1,876,853 | A * | 9/1932 | Carley et al. | 24/95 |
| 1,876,854 | A * | 9/1932 | Carley | 24/95 |
| 2,932,073 | A | 4/1960 | Ridgway | |
| 3,351,987 | A | 11/1967 | Tarullo | |
| 4,180,899 | A * | 1/1980 | Mikosinski | 24/691 |
| 2005/0160562 | A1 | 7/2005 | Hasegawa et al. | |

FOREIGN PATENT DOCUMENTS

| | | | |
|---|---|---|---|
| JP | S59-57108 | | 4/1984 |
| JP | 61202214 | U | 12/1986 |
| JP | S62-123108 | | 8/1987 |
| JP | S63260501 | A | 10/1988 |
| JP | 2003-310309 | A | 11/2003 |

OTHER PUBLICATIONS

International Search Report, PCT Application No. PCT/JP2010/053100, mailed Apr. 20, 2010.

Office Action, Japanese Patent Application No. 2013-152051, mailed Jul. 29, 2014.

* cited by examiner

BUTTON FASTENER, METHOD FOR FORMING BUTTON FASTENER, EYELET, AND METHOD FOR FORMING EYELET

This application is a national stage of PCT/JP2010/053100 which is incorporated herein by reference.

BACKGROUND OF THE INVENTION

The present invention relates to a button fastener, a method for forming a button fastener, an eyelet, and a method for forming an eyelet, and more specifically to a metallic button fastener with a cylindrical post to be passed through a cloth when a button such as a male snap button, a decorative button is fastened to the cloth, a method for forming such a button fastener, a metallic eyelet with a cylindrical part to be passed through a cloth to fasten the eyelet to the cloth, and a method for forming such an eyelet.

As a male snap button (male snap) of a set of snap buttons as widely used in e.g. parts to be put together of clothes or a decorative button to be fixed to e.g. corners of a pocket of jeans, one has been known which includes a disk-like flange and a protrusion which protrudes from the flange in its center area, the distal end of the protrusion being closed. When such a male snap button or a decorative button becomes fastened to a cloth, a button fastener is generally used, which is formed by drawing one metal plate and includes a base and a post projecting from a center part of the base. That is, after the post of the button fastener has just pierced the cloth, the post is received in an inside space of the protrusion of the male snap button or decorative button and then deformed to be fixed in the space, and thereby the button as e.g. the male snap is fastened to the cloth. Such a button fastener is disclosed in U.S. Pat. No. 3,351,987, for instance. Also, as an eyelet to be fixed to a cloth for passing air, water, etc., one has been known which comprises an eyelet body including a base and a cylindrical part projecting from the base, and an perforated member which is attached to the cylindrical part of the eyelet body from the outside.

In the above post of the button fastener formed from one metal plate, the distal end face and the proximal end face of the post are open as a top opening and a bottom opening, respectively. Therefore, when a button is fastened to a cloth, a piece of the cloth, which has been separated from the cloth by the post piercing the cloth, would catch on a swaged distal side part of the post, or a piece or part of the cloth which is not completely separated from the cloth would remain inside the post. In these cases, it would be possible to see the cloth piece from the bottom side of the base of the button fastener through the bottom opening, which would make the appearance less attractive. To avoid this, an additional work to eject the cloth piece through the bottom opening is needed. Further, a swaged distal side part of the post can be seen from the bottom opening, which may also cause disfigurement. Although a button fastener with the proximal end of the post closed has been known, such a button fastener cannot be produced by drawing one metal plate, and it needs an assembling step to attach a separate member to the bottom opening of the post, which involves increasing product cost. Besides, the above-mentioned eyelet for passing air, water, etc. needs the perforated member other than the eyelet body, increasing the material cost for that.

[Patent document 1] U.S. Pat. No. 3,351,987

An object of the invention as made in view of the above-mentioned problems is to provide a button fastener and a method for forming the button fastener with which a piece of a cloth, which may remain within a post of the button fastener as being completely or incompletely separated from the cloth during fastening a button to the cloth, or a swaged distal part of the post cannot be seen from the back side of the button fastener, enhancing the appearance as seen from the back side, and to provide a button fastener and a method for forming the button fastener which can be made from one metal plate cost advantageously.

Another object of the invention is to provide an eyelet and a method for forming the eyelet for passing air, water, etc. which can be made cost advantageously.

SUMMARY OF THE INVENTION

To solve the problems, according to the present invention, there is provided a button fastener made of metal for fastening a button to a cloth (the cloth includes fabric, textile, felt, nonwoven cloth, leather, resin sheet. Hereinafter the same shall apply), comprising a plate-like base and a cylindrical post projecting from a center area of the base, the distal end face of the post being open as a top opening, and the proximal end face of the post being open in the center area of the base as a bottom opening, wherein the button fastener includes a closing member which closes the inside of the post at a proximal side thereof.

In the invention, the closing member is provided inside the post at a proximal side thereof, and the post has the top opening and the bottom opening. Therefore, a cloth piece, which can be separated from the cloth as the button is fastened to the cloth, or a swaged distal part of the post cannot be seen through the bottom opening.

As a material of the button fastener, aluminum alloy, copper alloy, etc. are preferably cited, but other metals can be used.

In an embodiment of the invention, the closing member is fixed in the post by the outer surface of the closing member contacting and pressing the inner surface of the post. In this case, the outer diameter of the closing member was made slightly larger than the inner diameter of a proximal side of the post, and the closing member is pushed into the post proximally. Thereby, the outer surface of the closing member contacts and presses the inner surface of the post, and with a frictional force in between, the closing member is fixed.

In an embodiment of the invention, the post includes a stepped part on its inner surface at a proximal side with the inner diameter reduced proximally in a stepped manner, and the closing member is fixed on the stepped part. In this case, the closing member cannot move to the bottom opening inside the post by catching on the stepped part. When a semifinished product as described later is fabricated to the button fastener, a punch can be moved through the inside of the post toward its proximal end while slightly expanding the inner diameter of the post, and then stopped. The stepped part can be formed on the inner surface of the post at a proximal side at the boundary between the area where the inner diameter has been expanded and the area where the inner diameter remains unexpanded.

In an embodiment of the invention, the closing member is a closing part which has been cut out of an unfinished post of a semifinished product which is fabricated to the button fastener, the closing part before being cut out closing the distal end face of the unfinished post. In this case, first the semifinished product is formed from one metal plate, and then the closing part which closes the distal end face of the unfinished post of the semifinished product is punched or cut out. The closing part as punched is used as the closing member of the button fastener, and the unfinished post is formed to the post of the button fastener. Therefore, materials for the closing member other than the metal plate are unnecessary.

In the invention, the closing member may be formed in e.g. circular, polygonal, star, petal forms.

In an embodiment of the invention, the portion of the post which corresponds to the closing member is depressed radially inward at two or more points in the circumferential direction. Thereby, the strength to fix the closing member can increase, and it would be possible to improve the appearance of the button fastener seen from the back side through the bottom opening such as by providing the post with four depressed portions in the circumferential direction at the 90 degree interval so as to form the closing member in an almost cross shape.

According to another aspect of the present invention, there is provided a method for forming a button fastener made of metal for fastening a button to a cloth, the button fastener comprising a plate-like base and a cylindrical post projecting from a center area of the base, the distal end face of the post being open as a top opening, the proximal end face of the post being open in the center area of the base as a bottom opening, and the button fastener including a closing member which closes the inside of the post at a proximal side thereof, the method comprising the steps of: providing a semifinished product which comprises a plate-like base and an unfinished post projecting from a center area of the base, the unfinished post including a closing part which closes the distal end face of the unfinished post, and the proximal end face of the unfinished post being open in the center area of the base as a bottom opening; cutting out the closing part of the unfinished post of the semifinished product by a punch; and displacing the cut-out closing part with the punch through the inside of the unfinished post toward a proximal end to be used as the closing member.

In the invention, to form the above-stated button fastener, firstly the semifinished product can be formed from one metal plate, the semifinished product including the unfinished post with the distal end face closed by the closing part. Next, the closing part of the semifinished product can be punched or cut out by the punch, and then the cut-out closing part is displaced by the punch through the inside of the unfinished post toward the proximal end to be the closing member. The unfinished post of the semifinished product is formed to the post of the button fastener by the punch cutting out and moving the closing part.

In the invention, in the displacing step, the punch can displace the closing part while slightly expanding the inner diameter of the unfinished post. In this case, the punch moves proximally through the inside of the unfinished post of the semifinished product while slightly expanding the inner diameter of the unfinished post and then stops. Thereby, on the inner surface of the unfinished post at a proximal side thereof, at the boundary between the area where the inner diameter has been expanded and the area where the inner diameter remains unexpanded, a stepped part is formed. The closing part can be fixed on the stepped part.

According to another aspect of the present invention, there is provided an eyelet made of metal to be fastened to a cloth, comprising a plate-like base and a cylinder projecting from a center area of the base, the distal end face of the cylinder being open as a top opening, and the proximal end face of the cylinder being open in the center area of the base as a bottom opening, wherein the eyelet includes a closing member which closes the inside of the cylinder at a proximal side thereof.

In the invention, by punching the distal end face of the cylinder to be used as the closing member, it is possible to form the eyelet cost advantageously.

In an embodiment of the invention, the closing member is fixed in the cylinder by the outer surface of the closing member contacting and pressing the inner surface of the cylinder. In this case, the outer diameter of the closing member was made slightly larger than the inner diameter of a proximal side of the cylinder, and the closing member is pushed into the cylinder proximally. Thereby, the outer surface of the closing member contacts and presses the inner surface of the cylinder, and with a frictional force in between, the closing member is fixed.

In an embodiment of the invention, the cylinder includes a stepped part on its inner surface at a proximal side with the inner diameter reduced proximally in a stepped manner, and wherein the closing member is fixed on the stepped part. In this case, the closing member cannot move to the bottom opening inside the cylinder by catching on the stepped part. When a semifinished product as described later is fabricated to the eyelet, a punch can be moved through the inside of the cylinder toward its proximal end while slightly expanding the inner diameter of the cylinder, and then stopped. The stepped part can be formed on the inner surface of the cylinder at a proximal side at the boundary between the area where the inner diameter has been expanded and the area where the inner diameter remains unexpanded.

In an embodiment of the invention, the closing member is a closing part which has been cut out of an unfinished cylinder of a semifinished product which is fabricated to the eyelet, the closing part before being cut out closing the distal end face of the unfinished cylinder. In this case, first the semifinished product is formed from one metal plate, and then the closing part which closes the distal end face of the unfinished cylinder of the semifinished product is punched or cut out. The closing part as punched is used as the closing member of the eyelet, and the unfinished cylinder is formed to the cylinder of the eyelet. Therefore, materials for the closing member other than the metal plate is unnecessary.

In an embodiment of the invention, the closing member has a plurality of holes. Through the holes, air, water, etc. can flow in and out.

According to another aspect of the present invention, there is provided a method for forming an eyelet made of metal to be fastened to a cloth, the eyelet comprising a plate-like base and a cylinder projecting from a center area of the base, the distal end face of the cylinder being open as a top opening, the proximal end face of the cylinder being open in the center area of the base as a bottom opening, and the eyelet including a closing member which closes the inside of the cylinder at a proximal side thereof, the method comprising the steps of: providing a semifinished product which comprises a plate-like base and an unfinished cylinder projecting from a center area of the base, the unfinished cylinder including a closing part which closes the distal end face of the unfinished cylinder, and the proximal end face of the unfinished cylinder being open in the center area of the base as a bottom opening; cutting out the closing part of the unfinished cylinder of the semifinished product by a punch; and displacing the cut-out closing part with the punch through the inside of the unfinished cylinder toward a proximal end to be used as the closing member.

In the invention, to form the above-stated eyelet, firstly the semifinished product can be formed from one metal plate, the semifinished product including the unfinished cylinder with the distal end face closed by the closing part. Next, the closing part of the semifinished product can be punched or cut out by the punch, and then the cut-out closing part is displaced by the punch through the inside of the unfinished cylinder toward the proximal end to be the closing member. The unfinished cylinder of the semifinished product is formed to the cylinder of the eyelet by the punch cutting out and moving the closing part.

In the invention, in the displacing step, the punch can displace the closing part while slightly expanding the inner diameter of the unfinished cylinder. In this case, the punch moves proximally through the inside of the unfinished cylinder of the semifinished product while slightly expanding the inner diameter of the unfinished cylinder and then stops. Thereby, on the inner surface of the unfinished cylinder at a proximal side thereof, at the boundary between the area where the inner diameter has been expanded and the area where the inner diameter remains unexpanded, a stepped part is formed. The closing part can be fixed on the stepped part.

In the button fastener and the method for forming it, the closing member is provided inside the post at a proximal side thereof, and the post has the top opening and the bottom opening. Therefore, a cloth piece, which can stay within the post after being separated completely or incompletely from the cloth as the button is fastened to the cloth, or a swaged distal part of the post cannot be seen through the bottom opening, enhancing the appearance. An additional work to eject the cloth piece through the bottom opening of the button fastener is not needed. Further, the button fastener including the closing member can be formed from one metal plate effectively and cost advantageously.

In the eyelet and the method for forming it, the closing member is provided inside the cylinder at a proximal side thereof, and the eyelet including the closing member can be formed from one metal plate effectively and cost advantageously.

DETAILED DESCRIPTION OF THE INVENTION

Figure 1:
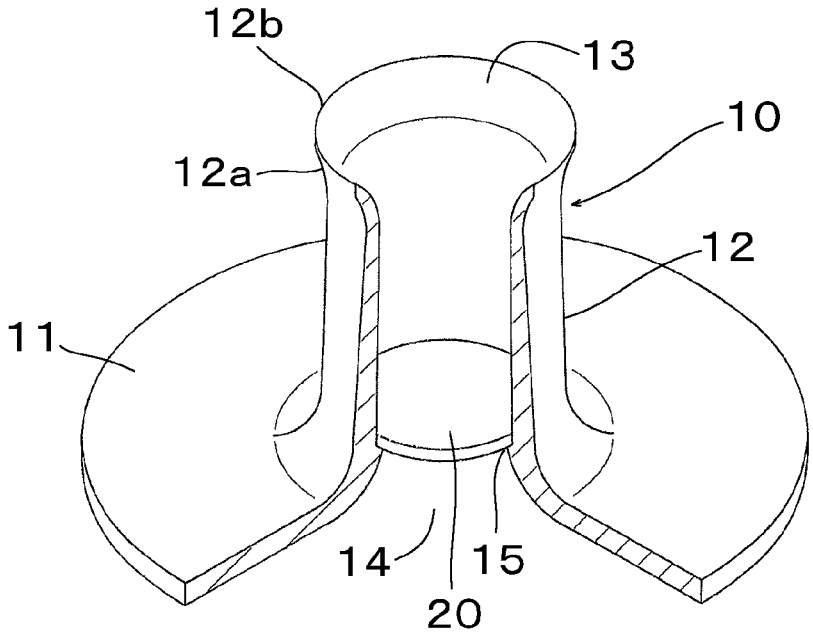
FIG. 1 is a partially cutaway perspective view of a button fastener in accordance with an embodiment of the invention.
Figure 2:
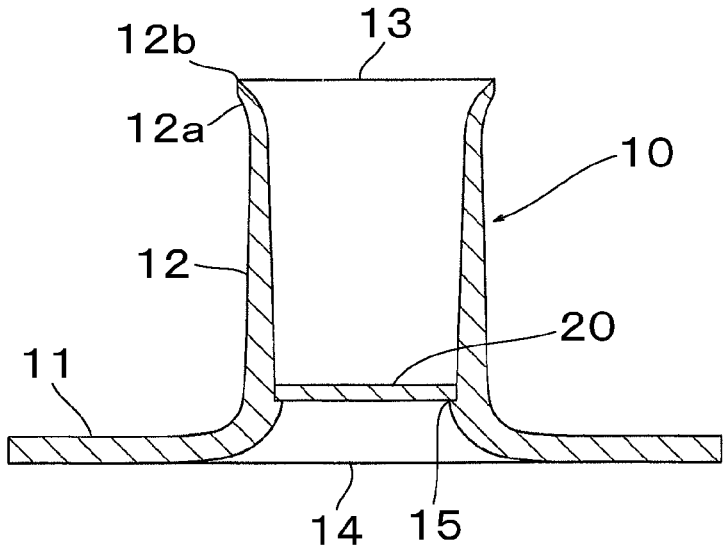
FIG. 2 is a longitudinal sectional view of the button fastener in FIG. 1.

Hereinafter, preferred embodiments of the present invention will be described with reference to the drawings. FIG. 1 is a partially cutaway perspective view of a button fastener 10 in accordance with an embodiment of the invention. FIG. 2 is a longitudinal sectional view of the button fastener 10. The button fastener 10 is fabricated by first forming a semifinished product 10' (see FIG. 3) and then finishing it. The semifinished product 10' is formed by drawing a plate material of copper alloy. The button fastener 1 comprises a disk-like base 11 and a cylindrical post 12 projecting upward (the up-and-down direction of the button fastener is based on FIG. 2) from the base 11 concentrically therewith. The upper end face of the post 12 is open as a top opening 13 and the lower end face thereof is open as a bottom opening 14. The thickness of the post 12 becomes gradually thinner upward, and an upper end part 12*a* of the post 12 expands as it opens radially outward with the top (upper end) 12*c* sharpened. The outer diameter of the post 12 except for the upper end part 12*a* is almost constant, and the inner diameter thereof gradually slightly increases upward from a stepped part 15 as described later. At a lower end side inside the post 12, there is provided a disk-like closing member 20. As described in detail later, a cloth piece 1', 2' can be produced by being separated from a cloth 1, 2 when a male snap button 40 (see FIG. 5) or a decorative button 50 (see FIG. 6) is fastened to the cloth 1, 2 using the button fastener 10, and the closing member 20 can hide the cloth piece 1', 2' from the bottom opening 13 even if it is left inside the post 12. At a lower end side on the inner peripheral surface of the post 12, there is formed a stepped part 15 at which the inner diameter is reduced downward in a stepped manner. The closing member 20 is disposed on the stepped part 15. The inner diameter of the stepped part 15 is slightly smaller than the outer diameter of the closing member 20, so that the closing member 20 is hindered from moving down by catching on the stepped part 15. In addition, the outer surface of the closing member 20 contacts and presses the inner surface of the post 12 and, with a frictional force in between, the closing member 20 in the post 12 cannot be displaced upward as well.

Figure 3:
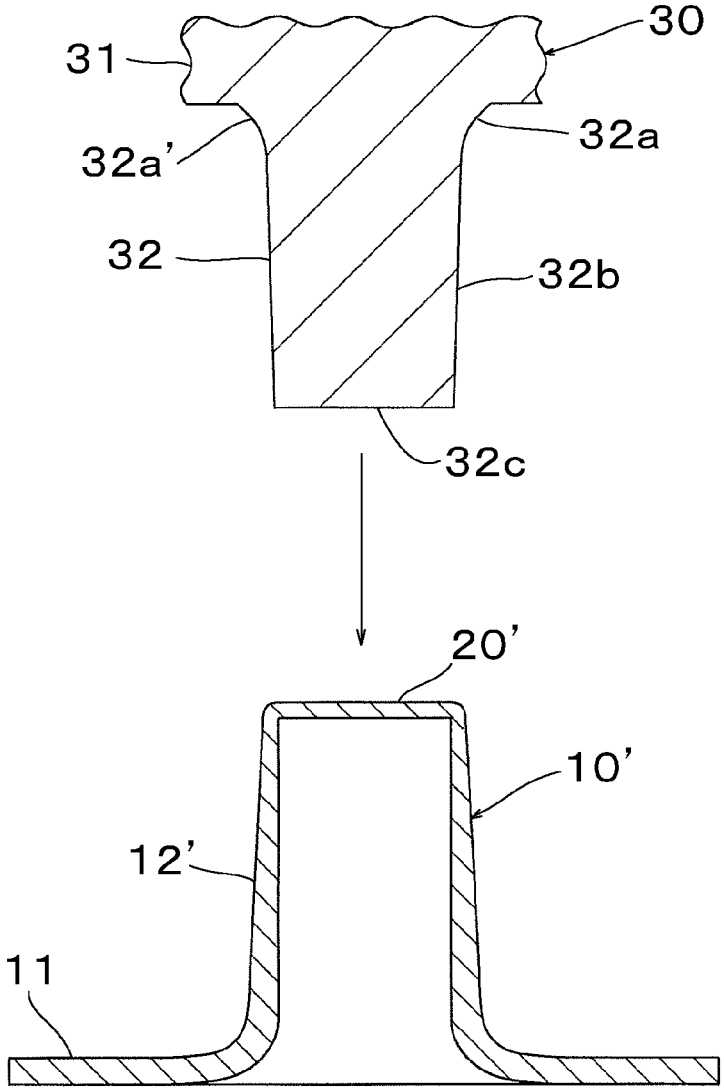
FIG. 3 is an illustrative longitudinal sectional view of a state where a semifinished product which will become the button fastener and a punch for use in a finishing step of the button fastener are arranged in the up-and-down direction.

FIG. 3 shows a state where the semifinished product (half-finished product) 10' which will become the button fastener 10 and a steel punch 30 for forming the semifinished product 10' to the button fastener 10 are arranged in the up-and-down direction. The punch 30 is placed above the semifinished product 10' concentrically. The semifinished product 10' is formed by drawing a metal plate, and comprises a base 11 (the same numeral is used as with the button fastener 10 as being substantially common) and an unfinished post 12' projecting from a center area of the base 11. The upper end face of the unfinished post 12' is closed by a disk-like closing part 20'. Further, the unfinished post 12' does not include an upper end part with its diameter expanding radially outward as the upper end part 12*a* of the post 12 of the button fastener 10, and the outer diameter of the unfinished post 12' slightly decreases upward in a straight manner and the inner diameter thereof is almost constant. Therefore, the inner and outer diameters of the unfinished post 12' slightly decrease upward relative to the post 12.

The punch 30 includes a punch base 31 as shown in a cutaway manner, which is connected to a up-and-down part of a press machine as not shown, and an almost columnar insert part 32 projecting downward from the punch base 31 with the outer diameter reduced, to be pressed into the unfinished post 12' of the semifinished product 10'. The insert part 32 includes an insert proximal part 32*a* defining a curved surface 32*a'* with the diameter reduced downward (the up-and-down direction of the punch is based on FIG. 3) from the punch base 31 in a curved manner, and an insert body 32*b* with the outer diameter slightly reduced downward from the insert proximal part 32*a* in a straight manner. The diameter of the bottom surface 32*c* of the insert part 32 is slightly larger than the inner diameter of the unfinished post 12', and the axial length of the insert part 32 is somewhat shorter than that of the unfinished post 12'.

Figure 4:
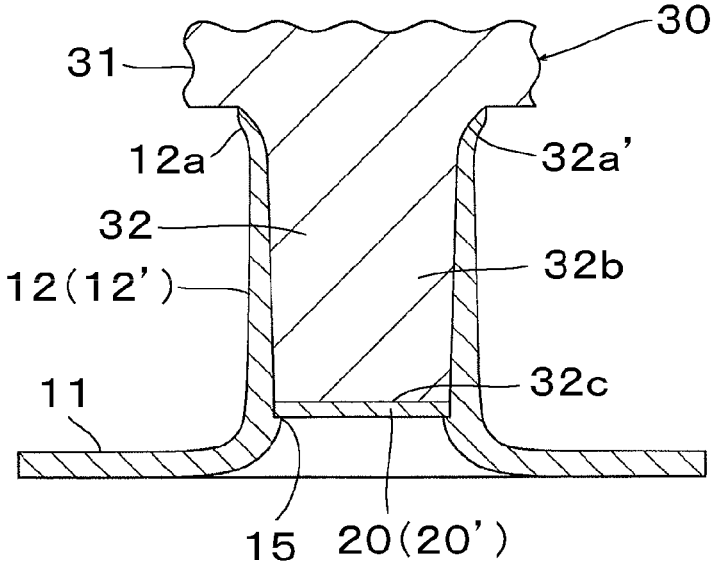
FIG. 4 is an illustrative longitudinal sectional view showing a state where the fabrication from the semifinished product to the button fastener has been completed.

Next, a procedure to obtain the button fastener 10 from the semifinished product 10' will be described as an embodiment of a method for forming the button fastener in accordance with the present invention. To finally fabricate the semifinished product 10' to the button fastener 10, the punch 30 is lowered from the FIG. 3 state and then punches or cuts out, in a circular form, the closing part 20' closing the top face of the unfinished post 12' of the semifinished product 10'. Then the insert part 32 of the punch 30 moves down through the inside of the unfinished post 12' while pushing down the closing part 20', which has just been cut out, with the bottom surface 32*c* of the insert part 32. By stopping the punch 30 at the FIG. 4 state, the step from the semifinished product 10' to the button fastener 10 is completed. For the sake of a simple explanation, the post 12 and the closing member 20 in the button fastener in FIG. 4 will also be referred to as the unfinished post 12' and the closing part 20' in the semifinished product 10'. During the insert part 32 moving down in the unfinished post 12', the insert body 32*b* and the cut-out closing part 20' deform the unfinished post 12' so as to slightly expand the inner diameter of the unfinished post 12' radially outward. In the meantime, the inner diameter of the unfinished post 12' below the position, near the lower end of the unfinished post 12', at which the closing part 20' has been stopped as the closing member 20 of the button fastener 10 remains unchanged. Therefore, the inner surface area of the unfinished post 12' corresponding to the position of the closing part 20' stopped, there is formed the stepped part 15 at which the inner diameter is reduced downward in a stepped manner. On the stepped part 15, the outer surface of the closing member 20 contacts and presses the inner surface of the unfinished post 12', and with a frictional force in between, the closing member 20 is fixed. Further, at the final stage of lowering the punch 30, the curved surface 32*a'* of the insert proximal part 32*a* expands the upper end part of the unfinished post 12' radially outward to form the upper end part 12*a* of the post 12. As described above, it is possible to do the finishing step from the semifinished product 10', which has been formed from one metal plate, to the button fastener 10 including the closing member 20, and therefore another material for the closing member 20 is unnecessary enhancing material efficiency.

Figure 5:
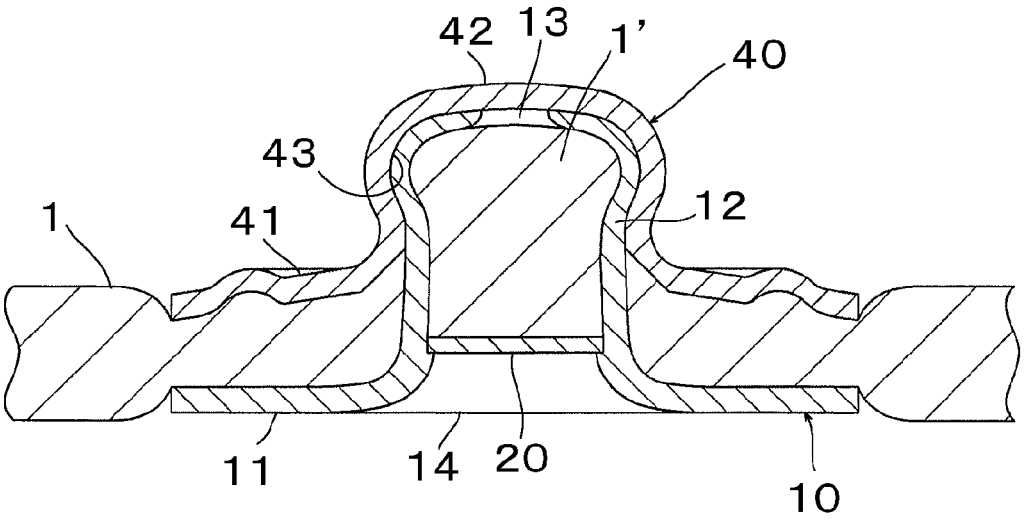
FIG. 5 is an illustrative longitudinal sectional view showing a state where a male snap button has been fastened to a cloth using the button fastener in FIG. 1 etc.

FIG. 5 is an illustrative longitudinal sectional view showing a state where a male snap button (hereinafter referred to also as simply "male snap") 40 has been fastened to a cloth 1 using the button fastener 10. The male snap 40 comprises a flange 41, and a protrusion 42 which protrudes from the flange 41 in its center area, the distal end of the protrusion 42 being closed. The protrusion 42 is engaged and disengaged with a recess of a female snap button as not shown. Inside the protrusion 42, there is defined a post-fixing space 43 to receive, deform and fix the post 12 of the button fastener 10. When the male snap 40 is fastened to the cloth 1 with the button fastener 10, the post 12 of the button fastener 10 goes into the post-fixing space 43 after piercing the cloth 1. By the post 12 piercing the cloth 1, a round cloth piece 1' is separated from the cloth 1. When the post 12 is deformed in the post-fixing space 43, the cloth piece 1' can stay within the post 12 such as by catching on a distal part of the post 12 (a cloth piece which is not completely separated from the cloth 1 may also remain inside the post 12). FIG. 5 (and FIG. 6) indicates a state where the cloth piece 1' has been captured in the post 12 through the top opening 13 for the sake of expediency. This cloth piece 1' staying in the post 12 and the deformed distal part of the post 12 cannot be seen through the bottom opening 14 by the presence of the closing member 20 in the vicinity of the lower end of the post 12.

Figure 6:
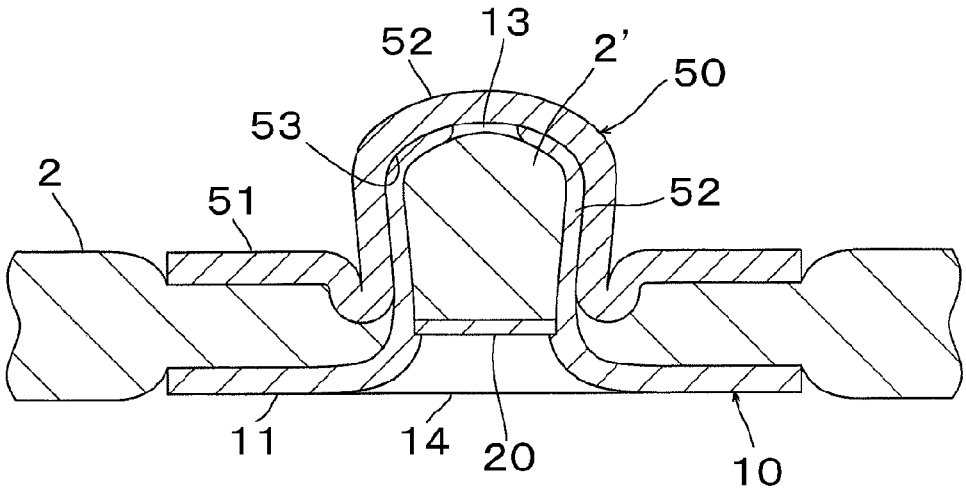
FIG. 6 is an illustrative longitudinal sectional view showing a state where a decorative button has been fastened to a cloth using the button fastener in FIG. 1 etc.

FIG. 6 is an illustrative longitudinal sectional view showing a state where a decorative button 50 has been fastened to a cloth 2 using the button fastener 10. The decorative button 50 comprises a flange 51, and a protrusion 52 which protrudes from the flange 51 in its center area, the distal end of the protrusion 52 being closed. Inside the protrusion 52, there is defined a post-fixing space 53 to receive, deform and fix the post 12 of the button fastener 10. When the decorative button 50 is fastened to the cloth 2 with the button fastener 10, the post 12 of the button fastener 10 goes into the post-fixing space 53 after piercing the cloth 2. By the post 12 piercing the cloth 2, a round cloth piece 2' is separated from the cloth 2. When the post 12 is deformed in the post-fixing space 53, the cloth piece 2' can stay within the post 12 (a cloth piece which is not completely separated from the cloth 2 may also remain inside the post 12). This cloth piece 2' staying in the post 12 and the deformed distal part of the post 12 cannot be seen through the bottom opening 14 by the presence of the closing member 20 in the vicinity of the lower end of the post 12.

Figure 7:
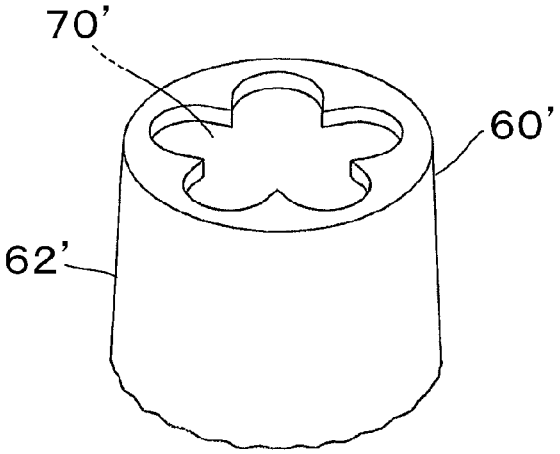
FIG. 7 is a cutaway perspective view of an upper half of the post expedientially showing another example of a punched form in the top face of the semifinished product.
Figure 8:
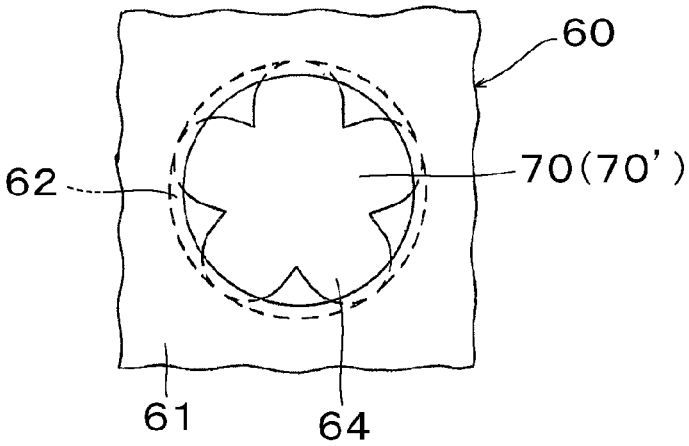
FIG. 8 is a partial bottom view, seen from below, of the button fastener as obtained from the semifinished product in FIG. 7.

In the embodiments, an example is cited wherein the top face or the closing part 20' of the semifinished product 10' is punched by the punch 30 in a circular form to make the closing member 20 circular, but the present invention is not limited thereto. In the invention, it is possible to punch the top face of the semifinished product in a form other than a circular form so as to form the closing member of the button fastener in a form other than a circular form. For example, FIG. 7 shows a state where the top face or the closing part 70' has been punched in a petal form with five semicircular petal pieces arranged radially. For the sake of a simple explanation, FIG. 7 shows the semifinished product 60' only through a punching process with a punch, which is not through, using a punch, a diameter expanding process to the unfinished post 62' and an expanding process to an upper end part of the unfinished post 62'. Although not shown, as a punch, the punch 30 in which a petal shaped bump is formed in the lower end part of the insert part 32 may be used. FIG. 8 is a partial bottom view, seen from below, showing a state where the closing part 70' which was punched in a petal form is fixed in the post 12 in the vicinity of its lower end as the closing member 70 of the button fastener 60. In a case where the male snap 40 or the decorative button 50 is fastened to the cloth 1 or 2 using the button fastener 60, the petal-like closing member 70 can been seen through the bottom opening 64 from the back side of the cloth 1, 2, which could enhance the appearance.

Figure 9:
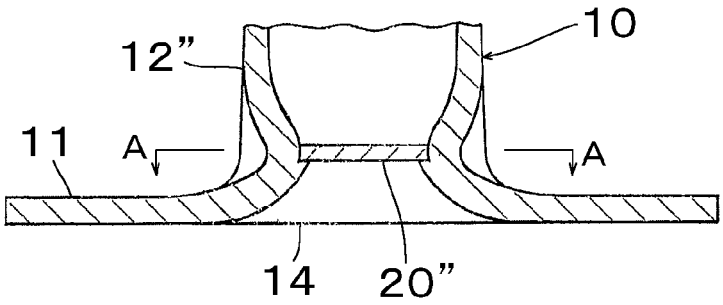
FIG. 9 is a cutaway longitudinal sectional view showing an example further modifying the button fastener.
Figure 10:
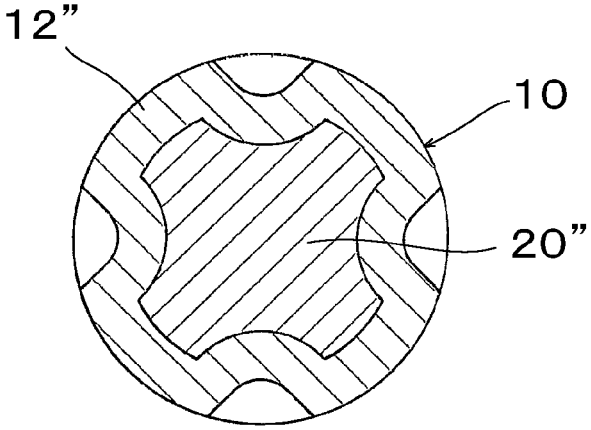
FIG. 10 is a sectional view taken along the line A-A in FIG. 9.

FIG. 9 shows a state where, after the semifinished product 10' has been finished to the button fastener 10 using the punch 30, the portion corresponding to the closing member 20 in the post 12 of the button fastener 10 is pressed radially inward and plastically deformed by a press member as not shown from, for instance, four points in the circumferential direction at the 90 degree interval so as to become depressed. The post 12 and the closing member 20 after being deformed are shown by the reference numerals 12", 20", respectively. FIG. 10 is a sectional view taken along the line A-A in FIG. 9. With this additional modification, the strength to fix the closing member 20" increases with the diameter of the post 12 reduced in the vicinity of its lower end. In addition, the closing member 20 is deformed in an almost cross shape, and also in this case, the appearance seen from the back side improves. Although, in the example, the closing member 20 is deformed in an almost cross shape, it is possible to form it in other shapes such as by increasing or decreasing pressing points on the post 12 in the circumferential direction.

Figure 11:
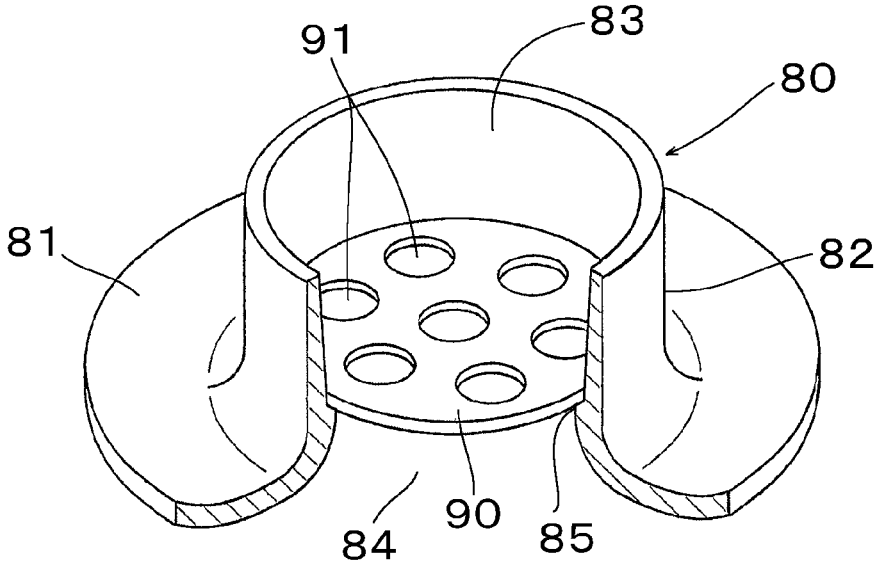
FIG. 11 is a partially cutaway perspective view of an eyelet in accordance with an embodiment of another aspect of the invention.
Figure 12:
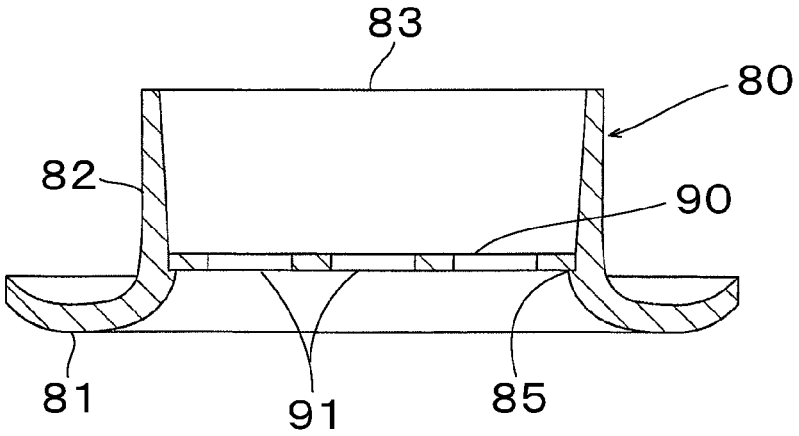
FIG. 12 is a longitudinal sectional view of the eyelet in FIG. 11.

FIG. 11 is a partially cutaway perspective view of an eyelet 80 in accordance with an embodiment of another aspect of the invention. The eyelet 80 creates holes for passing air, water, etc. by being fastened to a cloth 3 (see FIG. 5). FIG. 12 is a longitudinal sectional view of the eyelet 80. The eyelet 80 is fabricated by first forming a semifinished product 80' (see FIG. 13) by drawing a plate material of copper alloy, and then finishing the semifinished product as described later. The eyelet 80 comprises a disk-like base 81 and a cylinder 82 projecting upward (the up-and-down direction of the eyelet is based on FIG. 14) from the base 81 concentrically therewith. The upper end face of the cylinder 82 is open as a top opening 83 and the lower end face thereof is open as a bottom opening 84. The thickness of the cylinder 82 becomes gradually thinner upward. The outer diameter of the cylinder 82 is almost constant, and the inner diameter thereof gradually slightly increases upward from a stepped part 85. At a lower end side inside the cylinder 82, there is provided a disk-like closing member 90. The closing member 90 has, as an example, seven round holes 91 for passing air, water, etc. At a lower end side on the inner peripheral surface of the cylinder 82, there is formed a stepped part 85 at which the inner diameter is reduced downward in a stepped manner. The closing member 90 is disposed on the stepped part 85. The inner diameter of the stepped part 85 is slightly smaller than the outer diameter of the closing member 90, so that the closing member 90 is hindered from moving down by catching on the stepped part 85. In addition, the outer surface of the closing member 90 contacts and presses the inner surface of the cylinder 82, and with a frictional force in between, the closing member 90 in the cylinder 82 cannot be displaced upward as well.

Figure 13:
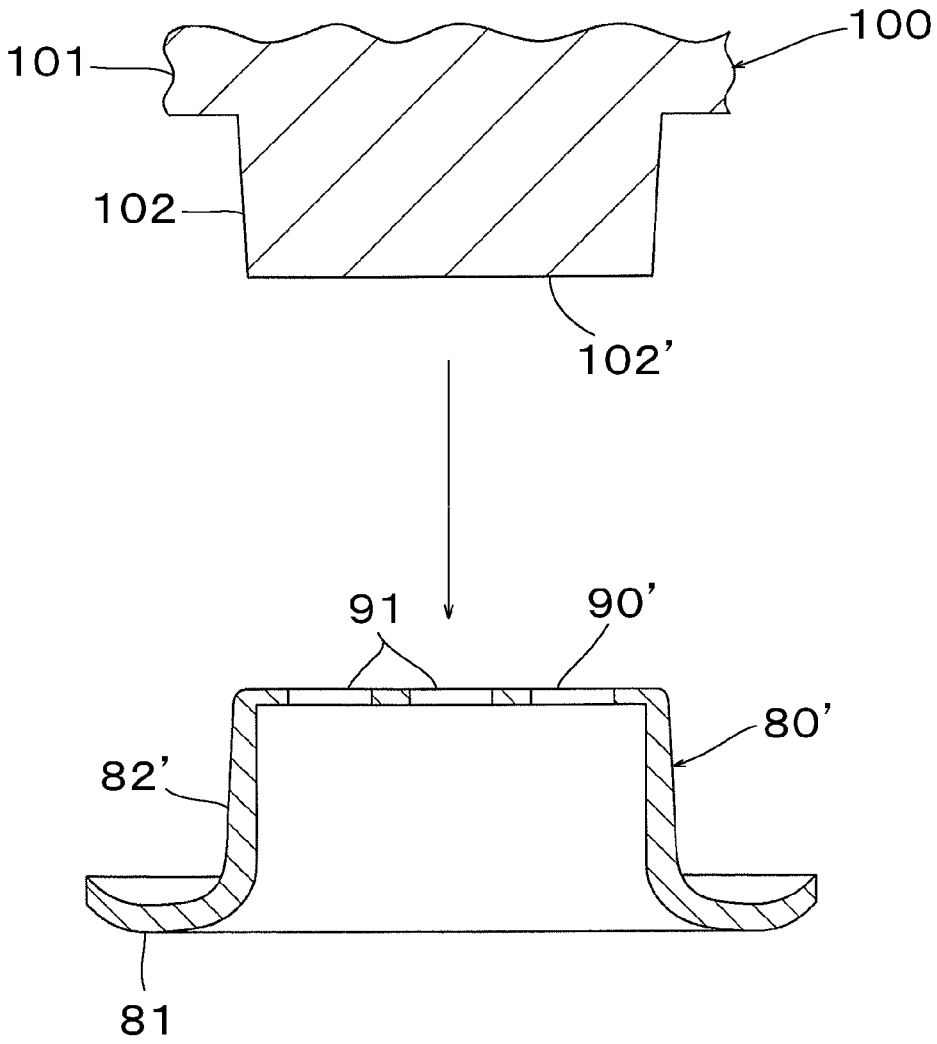
FIG. 13 is an illustrative longitudinal sectional view showing a state where a semifinished product which will become the eyelet and a punch for use in a finishing step of the eyelet are arranged in the up-and-down direction.
Figure 14:
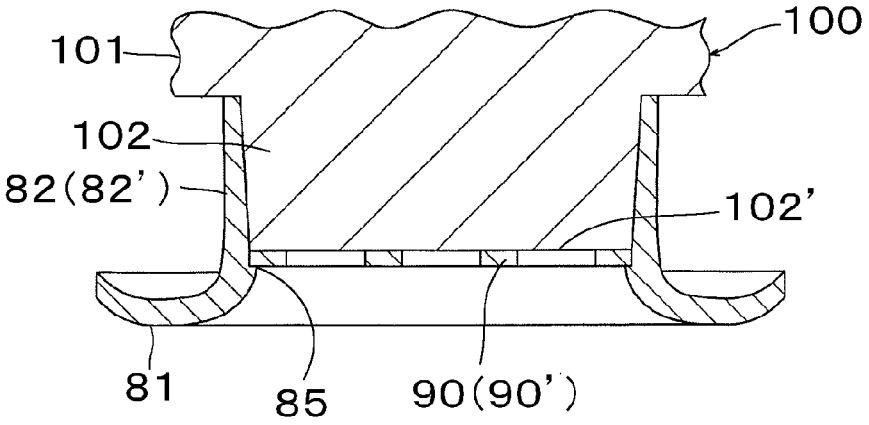
FIG. 14 is a longitudinal sectional view showing a state where the eyelet has been finished by the punch.

FIG. 13 shows a state where the semifinished product (half-finished product) 80' which will become the eyelet 80 and a steel punch 100 for forming the semifinished product 80' to the eyelet 80 are arranged in the up-and-down direction. The punch 100 is placed above the semifinished product 80' concentrically. The semifinished product 80' is formed by drawing a metal plate, and comprises a base 81 (the same numeral is used as with the eyelet 80 as being substantially in common) and an unfinished cylinder 82' projecting from a center area of the base 81. The upper end face of the unfinished cylinder 82' is closed by a disk-like closing part 90'. In the closing part 90', seven round holes 91 (the same reference numeral as with the closing member 90 is used as they are substantially the same) have been formed prior to the finishing with the punch 100. The outer diameter of the unfinished cylinder 82' slightly decreases upward in a straight manner and the inner diameter thereof is almost constant. Therefore, the inner and outer diameters of the unfinished cylinder 82' slightly decrease upward relative to the cylinder 82.

The punch 100 includes a punch base 101 as shown in a cutaway manner, which is connected to a up-and-down part of a press machine as not shown, and an almost columnar insert part 102 projecting downward from the punch base 101 with the outer diameter reduced, to be pressed into the unfinished cylinder 82' of the semifinished product 80'. The outer diameter of the insert part 102 slightly reduces downward from the punch base 101 in a straight manner, and the diameter of the bottom surface 102' of the insert part 102 is slightly larger than the inner diameter of the unfinished cylinder 82'. Further, the axial length of the insert part 102 is somewhat shorter than that of the unfinished cylinder 82'.

Next, a procedure to obtain the eyelet 80 from the semifinished product 80' will be described as an embodiment of a method for forming the eyelet in accordance with the present invention. To finally fabricate the semifinished product 80' to the eyelet 80, the punch 100 is lowered from the FIG. 13 state and then cuts out, in a circular form, the closing part 90' closing the top face of the unfinished cylinder 82' of the semifinished product 80'. Then the insert part 102 of the punch 100 moves down through the inside of the unfinished cylinder 82' while pushing down the closing part 90', which has just been cut out, with the bottom surface 102' of the insert part 102. By stopping the punch 102 at the FIG. 14 state at which the punch base 101 contacts the upper end of the unfinished cylinder 82', the step from the semifinished product 80' to the eyelet 80 is completed. For the sake of a simple explanation, the cylinder 82 and the closing member 90 in the eyelet in FIG. 14 will also be referred to as the unfinished cylinder 82' and the closing part 90' in the semifinished product 80'. During the insert part 102 moving down in the unfinished cylinder 82', the insert part 102 and the cut-out closing part 90' deform the unfinished cylinder 82' so as to slightly expand the inner diameter of the unfinished cylinder 82' radially outward. In the meantime, the inner diameter of the unfinished cylinder 82' below the position, near the lower end of the unfinished cylinder 82', at which the closing part 90' has been stopped as the closing member 90 of the eyelet 80 remains unchanged. Therefore, the inner surface area of the unfinished cylinder 82' corresponding to the position of the closing member 90 stopped, there is formed the stepped part 85 at which the inner diameter is reduced downward in a stepped manner. On the stepped part 85, the outer surface of the closing member 90 contacts and presses the inner surface of the unfinished cylinder 82', and with a frictional force in between, the closing member 90 is fixed. As described above, it is possible to do the finishing step from the semifinished product 80', which has been formed from one metal plate, to the eyelet 80 including the closing member 90, and therefore another material for the closing member 90 is unnecessary enhancing material efficiency.

Figure 15:
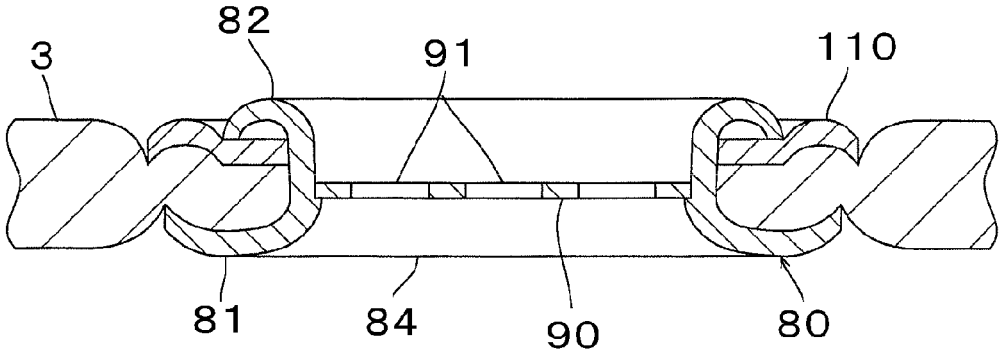
FIG. 15 is an illustrative longitudinal sectional view showing a state where the eyelet in FIG. 11 etc. has been fastened to a cloth.

FIG. 15 is an illustrative longitudinal sectional view showing a state where the eyelet 80 has been fastened to a cloth 3. In FIG. 15, the reference numeral 110 indicates an annular washer, which is placed on the front side (upper surface side) of the cloth 3. When the eyelet 80 is fastened to the cloth 3, the cylinder 82 of the eyelet 80 pierces the cloth 3 and then be curved radially outward in a C-letter form by an upper die as not shown to be received on the washer 110.

Description of Reference Numbers

1, 2, 3 cloth
1', 2' cloth piece
10 button fastener
10', 60' semifinished product
11 base

12, 12", 62 post
12', 62' unfinished post
13 top opening
14, 64 bottom opening
15 stepped part
20, 20", 70 closing member
20', 70' closing part
30, 100 punch
40 male snap button
50 decorative snap button
80 eyelet
80' semifinished product 80'
81 base
82 cylinder
82' unfinished cylinder 82'
83 top opening
84 bottom opening
85 stepped part
90 closing member
90' closing part
91 hole

The invention claimed is

1. A button fastener made of metal for fastening a button to a cloth, comprising a plate-like base and a cylindrical post projecting from a center area of the base, a distal end face of the post being open as a top opening, and a proximal end face of the post being open in the center area of the base as a bottom opening, wherein the button fastener includes a disk-like closing member which closes the inside of the post at a proximal side thereof.

2. The button fastener according to claim 1, wherein the closing member is fixed in the post by an outer surface of the closing member contacting and pressing an inner surface of the post.

3. The button fastener according to claim 1, wherein the post includes a stepped part on its inner surface at a proximal side with an inner diameter reduced proximally in a stepped manner, and wherein the closing member is fixed on the stepped part.

4. The button fastener according to claim 1, wherein a portion of the post which corresponds to the closing member is depressed radially inward at two or more points in the circumferential direction.

5. A method for forming a button fastener made of metal for fastening a button to a cloth, the button fastener comprising a plate-like base and a cylindrical post projecting from a center area of the base, a distal end face of the post being open as a top opening, a proximal end face of the post being open in the center area of the base as a bottom opening, and the button fastener including a disk-like closing member which closes the inside of the post at a proximal side thereof, the method comprising the steps of:

providing a semifinished product which comprises a plate-like base and an unfinished post projecting from a center area of the base, the unfinished post including a closing part which closes a distal end face of the unfinished post, and a proximal end face of the unfinished post being open in the center area of the base as a bottom opening;

cutting out the closing part of the unfinished post of the semifinished product by a punch; and displacing the cut-out closing part with the punch through the inside of the unfinished post toward a proximal end to be used as the closing member.

6. The method according to claim 5 wherein, in the displacing step, the punch displaces the closing part while slightly expanding an inner diameter of the unfinished post.

7. An eyelet made of metal to be fastened to a cloth, comprising a plate-like base and a cylinder projecting from a center area of the base, a distal end face of the cylinder being open as a top opening, and a proximal end face of the cylinder being open in the center area of the base as a bottom opening, wherein the eyelet includes a disk-like closing member which closes the inside of the cylinder at a proximal side thereof.

8. The eyelet according to claim 7, wherein the closing member is fixed in the cylinder by an outer surface of the closing member contacting and pressing an inner surface of the cylinder.

9. The eyelet according to claim 7, wherein the cylinder includes a stepped part on its inner surface at a proximal side with an inner diameter reduced proximally in a stepped manner, and wherein the closing member is fixed on the stepped part.

10. The eyelet according to claim 7, wherein the closing member has a plurality of holes.

11. A method for forming an eyelet made of metal to be fastened to a cloth, the eyelet comprising a plate-like base and a cylinder projecting from a center area of the base, a distal end face of the cylinder being open as a top opening, a proximal end face of the cylinder being open in the center area of the base as a bottom opening, and the eyelet including a closing member which closes the inside of the cylinder at a proximal side thereof, the method comprising the steps of:

providing a semifinished product which comprises a plate-like base and an unfinished cylinder projecting from a center area of the base, the unfinished cylinder including a closing part which closes a distal end face of the unfinished cylinder, and a proximal end face of the unfinished cylinder being open in the center area of the base as a bottom opening;

cutting out the closing part of the unfinished cylinder of the semifinished product by a punch; and displacing the cut-out closing part with the punch through the inside of the unfinished cylinder toward a proximal end to be used as the closing member.

12. The method according to claim 11 wherein, in the displacing step, the punch displaces the closing part while slightly expanding an inner diameter of the unfinished cylinder.

* * * * *